US006198890B1

(12) United States Patent
Liu et al.

(10) Patent No.: US 6,198,890 B1
(45) Date of Patent: Mar. 6, 2001

(54) ELECTROPHOTOGRAPHIC COLOR PRINTING ARRANGEMENT WITH INCLINED PHOTORECEPTOR PATH

(75) Inventors: Dean Liu; Ingrid Annemarie Farrington, both of Irvine, CA (US); Hsu Hung-Hsu, Taipei (TW)

(73) Assignee: Aetas Technology Corporation, Irvine, CA (US)

( * ) Notice: Subject to any disclaimer, the term of this patent is extended or adjusted under 35 U.S.C. 154(b) by 0 days.

(21) Appl. No.: 09/413,290

(22) Filed: Oct. 6, 1999

(51) Int. Cl.[7] ..... G03G 15/01
(52) U.S. Cl. ..... 399/107; 399/162; 399/224
(58) Field of Search ..... 399/162, 224, 399/392, 107, 223; 347/115, 118

(56) References Cited

U.S. PATENT DOCUMENTS

| | | | | |
|---|---|---|---|---|
| 4,982,242 | * | 1/1991 | Ishii et al. | 399/224 |
| 5,160,969 | * | 11/1992 | Mizuma et al. | 399/223 |
| 5,216,472 | * | 6/1993 | Muto et al. | 399/392 |
| 5,257,037 | | 10/1993 | Haneda et al. . | |
| 5,291,245 | | 3/1994 | Charnitski et al. . | |
| 5,313,259 | | 5/1994 | Smith . | |
| 5,444,515 | * | 8/1995 | Haneda et al. | 399/223 X |
| 5,473,421 | | 12/1995 | Maruyama et al. . | |
| 5,541,722 | | 7/1996 | Ikeda et al. . | |
| 5,557,377 | | 9/1996 | Loewen et al. . | |
| 5,557,394 | | 9/1996 | Haneda et al. . | |
| 5,752,137 | * | 5/1998 | Haneda et al. | 399/223 |

FOREIGN PATENT DOCUMENTS

53323688 * 12/1993 (JP) .

* cited by examiner

*Primary Examiner*—Joan Pendegrass
(74) *Attorney, Agent, or Firm*—Baker Botts, LLP

(57) ABSTRACT

An electrophotographic color printing arrangement includes a belt photoreceptor having a path of motion extending at an angle of about 35° to 60° with respect to the horizontal, a plurality of developing units disposed adjacent to the lower surface of the photoreceptor and a substrate supply container located beneath the developing units. A fuser unit is located above the lower end of the photoreceptor path remote from the photoreceptor and a photoreceptor cleaning unit located adjacent to the upper end of the photoreceptor path receiving toner from the photoreceptor and conveys it to a waste container.

20 Claims, 2 Drawing Sheets

ELECTROPHOTOGRAPHIC COLOR PRINTING ARRANGEMENT WITH INCLINED PHOTORECEPTOR PATH

BACKGROUND OF THE INVENTION

This invention relates to electrophotographic color printer arrangements.

Conventional electrophotographic color printer arrangements are in many cases inconveniently large in size and, in an effort to reduce size, some printers locate heat generating components close enough to the photoreceptor to subject the photoreceptor to undue heating, causing premature aging and substantial wear of the surface.

In the Chamitski et al. U.S. Pat. No. 5,291,245, an electrophotographic apparatus includes a photoreceptor belt supported for motion in a triangular path with four sets of charging, exposure, and development stations horizontally spaced adjacent to one portion of the belt, thereby requiring the printer to have a substantial length in the horizontal direction.

The Smith U.S. Pat. No. 5,313,259 discloses a multicolor electrophotographic printer having a photoreceptor belt which follows a generally oval path which is elongated in a vertical direction with three vertically aligned printing stations adjacent to the photoreceptor on one side of the oval path and one further printing station adjacent to the photoreceptor on the opposite side of the path. After an image has been generated and transferred from the photoreceptor belt to a sheet of paper, the paper is transported by a belt to a remote heat generating fuser which is spaced horizontally from the vertically elongated belt path to minimize heating of the photoreceptor from the fuser.

The patent to Maruyama et al. U.S. Pat. No. 5,473,421 discloses an electrophotographic multicolor image printer having a photoreceptor belt which is driven in a generally triangular path oriented with a long dimension in the vertical direction and includes a conveyor to convey a sheet of paper to which an image has been transferred to a remote fuser which is spaced in the horizontal direction from the photoreceptor belt.

In the Loewen et al. U.S. Pat. No. 5,557,377 a multicolor electrophotographic printer has a photoreceptor belt extending in a generally oval path which is elongated in the horizontal direction. In this printer, liquid toners are used which are pumped from liquid toner supply containers beneath the belt to developing units adjacent to the lower side of the belt.

The Haneda et al. U.S. Pat. No. 5,257,037 discloses an electrophotographic color printer having a photoreceptor belt supported in a generally elongated path oriented at an angle of 5° to 30° to the horizontal. A stepped arrangement of exposure lasers and developing units are mounted adjacent to the lower side of the photoreceptor path and paper sheets are transported from a sheet feed device disposed beneath the exposure and developing units to a transfer station at the lower end of the belt and then to a fuser adjacent to the lower end of the photoreceptor belt after transfer of an image. In this printer, a used toner recovery chamber is located inside the photoreceptor belt loop and toner cleaned from the surface of the photoreceptor after transfer of the image is directed by a screw conveyer into the used toner recovery chamber.

The Ikeda et al. U.S. Pat. No. 5,541,722 and the Haneda et al. U.S. Pat. No. 5,557,394 disclose electrophotographic color printing arrangements in which exposure units are mounted inside a moving photoreceptor having a transparent support surface. Since exposure units can be provided which do not occupy a significant amount of space, however, such arrangements do not per se reduce significantly the size of a multicolor electrophotographic printer.

SUMMARY OF THE INVENTION

Accordingly, it is an object of the present invention to provide an electrophotographic color printing arrangement which overcomes disadvantages of the prior art.

Another object of the invention is to provide an electrophotographic color printing arrangement having a compact structure while avoiding overheating of the photoreceptor by heat generating components of the printer.

A further object of the invention is to provide an electrophotographic color printing arrangement enabling convenient positioning of toner supply containers for a plurality of different color developing units to permit a large supply of toner while enabling the toner to be supplied by gravity to the developing units.

These and other objects of the invention are attained by providing an electrophotographic color printing arrangement having a belt shaped photoreceptor supported for motion in an elongated path extending at an angle to the horizontal which is in the range from about 35° to about 65° and a plurality of developing units disposed in spaced relation along the path of the photoreceptor adjacent to the lower side of the photoreceptor belt with corresponding toner supply units extending vertically above the developing units adjacent to one edge of the photoreceptor belt. A fuser unit is mounted in spaced relation to the photoreceptor belt in a region above the lower end of the photoreceptor belt so as to be spaced as far as possible from the photoreceptor belt in an enclosure having a substantially rectangular vertical outline. Preferably, a horizontal paper tray is removably supported beneath the developing units with a paper feed end adjacent to the lower end of the photoreceptor path from which a paper sheet can be transported to a transfer station and then transported substantially vertically to the fuser for image fusing and thereafter to a paper exit adjacent to an output tray.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
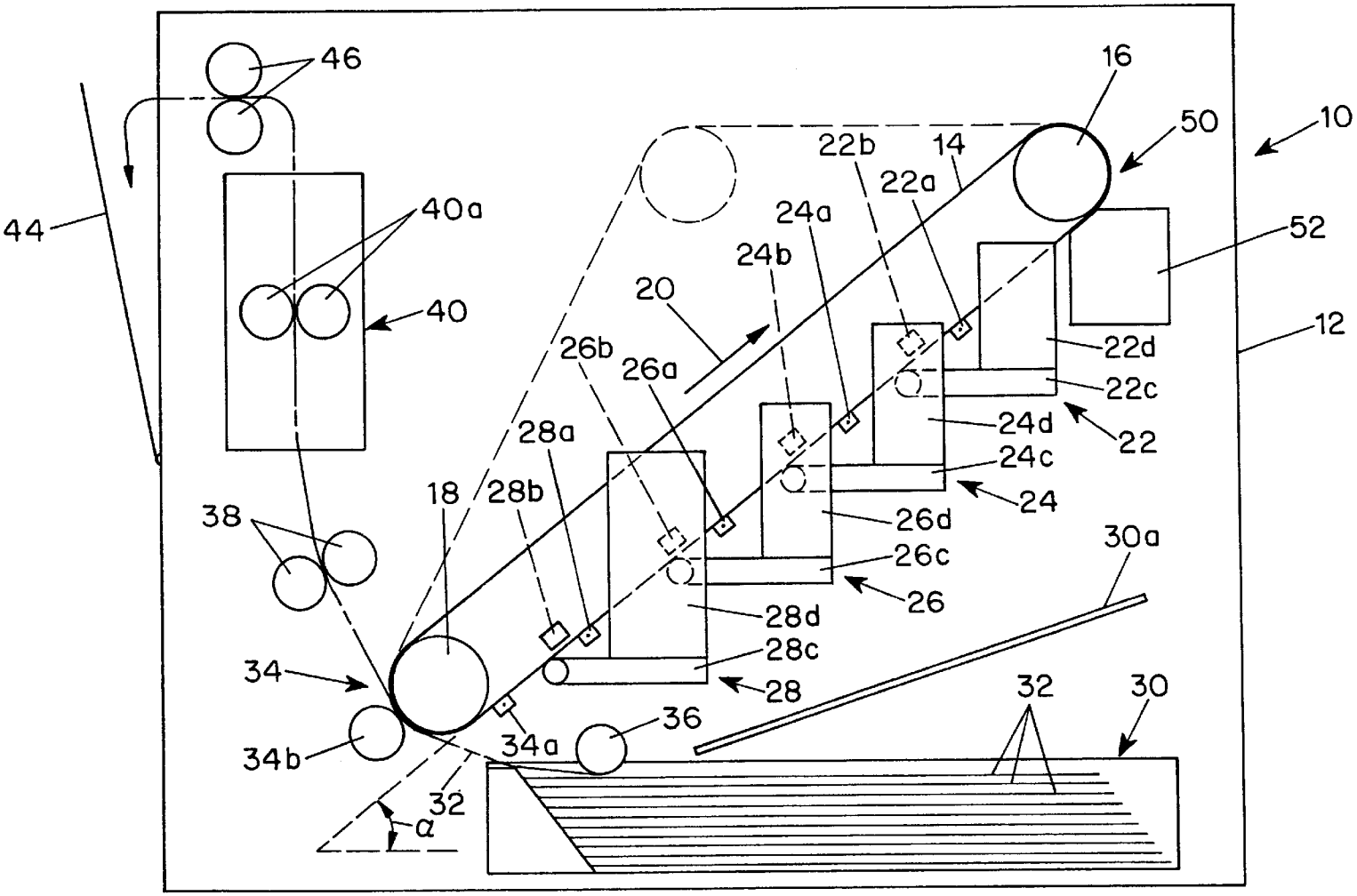
FIG. 1 is a schematic side view illustrating a representative embodiment of an electrophotographic color printing arrangement in accordance with the invention.

In the typical embodiment of the invention illustrated in the drawings, an electrophotographic color printer 10 is enclosed in a housing 12 of generally rectangular cross-sectional configuration and includes a photoreceptor belt 14 supported by rollers 16 and 18 and driven in the direction of the arrow 20 in an elongated path extending between the rollers. For the reasons discussed hereinafter, the rollers 16 and 18 are positioned so that the lower elongated path of the photoreceptor belt extends at an angle $\alpha$ of about 35° to 65° from the horizontal and preferably about 40° to 55° from the horizontal.

In order to produce multicolor images on the photoreceptor belt 14, which has a transparent base, four printing stations 22, 24, 26 and 28 are mounted adjacent to the belt 14 along the lower run of its elongated path to generate four successive images in different colors, i.e., yellow, magenta, cyan and black, on the outer surface of the photoreceptor belt. Each station includes a corona charging device 22*a*, 24*a*, 26*a* and 28*a* adjacent to the outer surface, an LED printhead 22*b*, 24*b*, 26*b* and 28*b* downstream of the charging device and adjacent to the inner surface of the photoreceptor belt and a developing unit 22*c*, 24*c*, 26*c* and 28*c* downstream of the LED printhead and adjacent to the outer surface. Each charging unit 22*a*, 24*a*, 26*a* and 28*b* applies a substantially uniform electrostatic charge to the surface of the photoreceptor and each exposure unit 22*b*, 24*b*, 26*b* and 28*b* exposes the photoreceptor through its transparent base to a light image corresponding to the color image to be reproduced in that unit and thereafter the developing unit 22*c*, 24*c*, 26*c* and 28*c* applies the appropriate color developer to the outer surface of the photoreceptor belt to develop the electrostatic image thus formed by the unit. The developing units may, for example, be of the type described in U.S. Pat. No. 5,899,609, the disclosure of which is incorporated by reference herein.

To assure an adequate supply of toner, each of the developing units 22*c*, 24*c*, 26*c* and 28*c* extends laterally outwardly from the path of the photoreceptor belt and has a corresponding toner supply container 22*d*, 24*d*, 26*d* and 28*d* extending upwardly from the developing unit to supply toner thereto by gravity. At a location beneath the developing units in the housing 12, a horizontal paper tray 30 supports a supply of sheets 32 of a substrate material such as paper to be selectively withdrawn and fed to a transfer station 34 by a feed roller 36. The tiered arrangement of the developing units and toner supply containers permits a larger container 28*d* to be provided for black toner which is used to a greater extent than the other toners, without increasing the overall height of the developing units or the housing. In addition, this arrangement provides room for a bypass feed tray 30 to be positioned above the tray 30 to permit insertion of a substrate sheet which is different from the sheets contained in the tray 30.

At the transfer station 34 a charging unit 34*a* charges the photoreceptor to facilitate transfer of the image and the multicolor image generated on the surface of the photoreceptor belt 14 at the printing stations 22, 24, 26 and 28 is transferred to the surface of the substrate sheet 32 as it passes through a nip formed with a transfer roller 34*b*. The sheet 32 with the transferred image is thereafter conveyed by rollers 38 to a fuser assembly 40 located above the lower roller 18 and spaced substantially from the surface of the photoreceptor 14 where the toner image is fused to the surface of the substrate as it passes between two fuser rolls 40*a*.

After the image has been fused on the substrate, the substrate sheet 32 is conveyed to an output tray 44 by two output drive rolls 46. Following transfer of the image to the substrate, the photoreceptor 14 moves to a cleaning station 50 at which any remaining toner is removed from the surface of the photoreceptor belt and conveyed to a waste container 52 for subsequent disposal.

Figure 2:
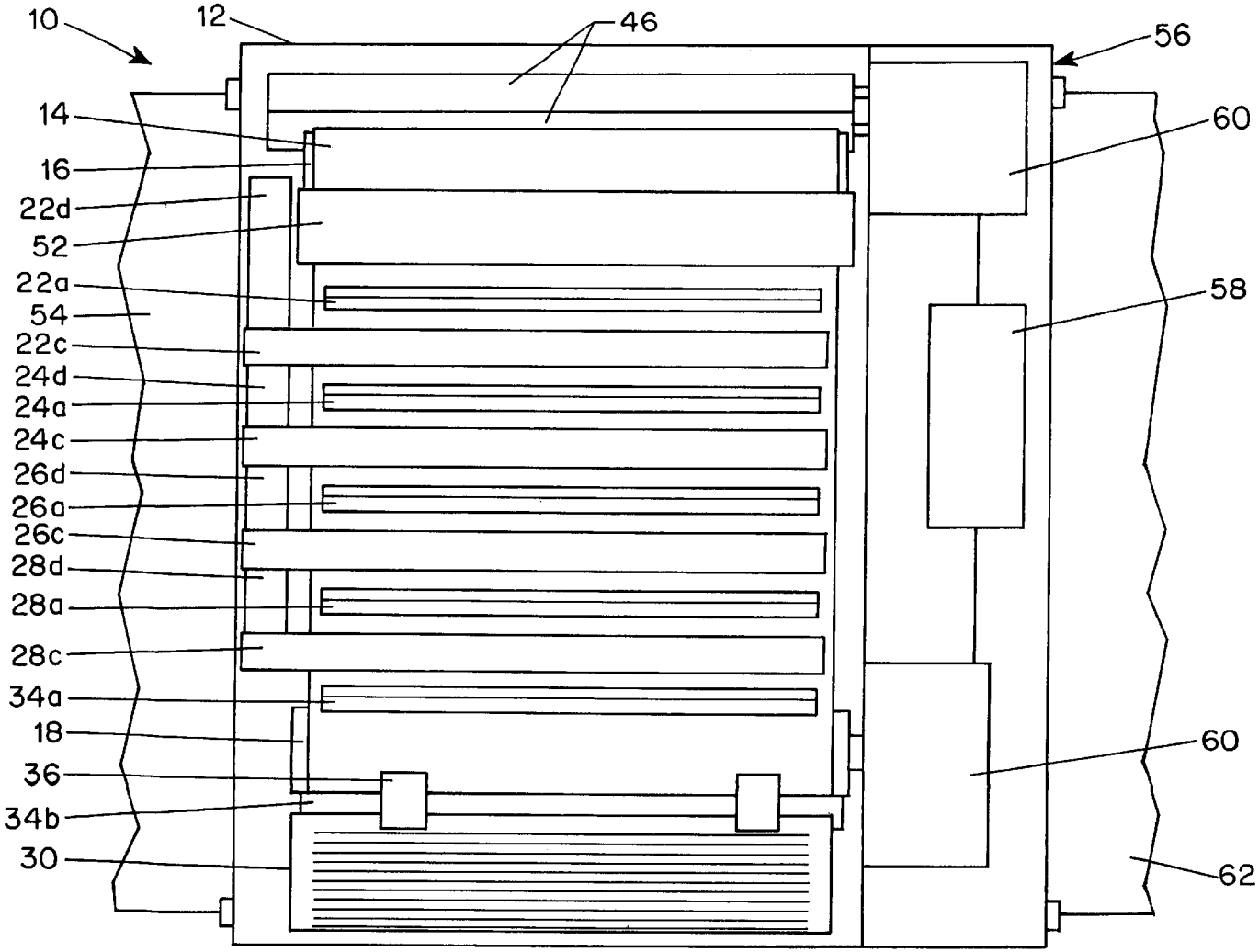
FIG. 2 is an end view of the arrangement shown in FIG. 1.

As best seen in FIG. 2, convenient access to the toner supply containers, the paper trays, and the other components described above is provided by a door 54 which is removed in the view shown in FIG. 1. FIG. 2 also shows a compartment 56 on the opposite side of the housing from the door 54 in which electronic and drive components 58 and 60 are mounted. A door 62 provides convenient access to those components.

By orienting the lower path of the photoreceptor 14 extending between the rolls 16 and 18 at an angle $\alpha$ of about 35° to about 65° from the horizontal, a compact arrangement of the components of the electrophotographic color printer can be effected. For example, the developing units 22*c*, 24*c*, 26*c* and 28*c* and their related toner supply containers 22*d*, 24*d*, 26*d* and 28*d* can conveniently be stacked in a tiered arrangement to facilitate vertical orientation of the toner containers and provide for convenient replacement when necessary without removing any of the other system components. Moreover, with this arrangement a short paper path is provided between the paper tray 30 and the transfer station 34 and the bypass tray 30*a* can be conveniently positioned above the main paper tray 30 without enlarging the housing. In addition, the fuser unit 40 can be spaced a substantial distance from the surface of the photoreceptor 14 to avoid degradation of the photoreceptor by the heat generated by the fuser unit without enlarging the housing and each of the major components of the electrophotographic color printing system can conveniently be withdrawn separately from the enclosure 12 for servicing or replacement if necessary.

In a typical embodiment potentially useful for commercial purposes, the housing 12 has a length, excluding the output tray 44, of about 18 inches, a height of about 13 inches and a width of about 20 inches including the electronic and drive components compartment 56 illustrated in FIG. 2.

It has been found that, if the angle $\alpha$ of the path of the photoreceptor adjacent to the developing units is less than about 35° with respect to the horizontal, insufficient space is provided for the developing units and the paper supply beneath the photoreceptor, thereby requiring a larger overall height whereas, if the angle of the path of the photoreceptor with respect to the horizontal is greater than about 65°, insufficient lateral space is provided for the developing units and the related toner supply containers and the photoreceptor cannot be spaced far enough from the fuser unit to avoid significant heating. If desired, a third photoreceptor guide roller may be provided between the rollers 16 and 18 in the upper run of the photoreceptor path to support the photoreceptor belt in a triangular path as shown in dashed outline in FIG. 1 if more space is required within the belt but the triangular path should be configured to keep the photoreceptor as far away from the fuser unit 40 as possible. Furthermore, if desired, the output tray 44 may be located in the top of the housing rather than at the side.

Although the invention has been described herein with reference to specific embodiments, many modifications and variations therein will readily occur to those skilled in the art. Accordingly, all such variations and modifications are included within the intended scope of the invention.

We claim:

1. An electrophotographic color printing arrangement comprising:

a photoreceptor belt supported for motion between an upper roller and a lower roller in a path having a lower run extending at an angle within the range from about 35° to about 65° from the horizontal;

a plurality of color printing stations disposed adjacent to the lower run of the photoreceptor path for producing successive images of different color on the photoreceptor, each printing station including a developer unit containing a different color developer;

a substrate supply container disposed beneath the printing stations for holding a supply of substrate sheets;

a transfer station adjacent to the lower roller for transferring a developed multicolor image to a substrate sheet supplied from the substrate sheet container; and a fuser unit positioned substantially above the lower end of the path of the photoreceptor for receiving a substrate sheet to which an image has been transferred and fusing the image thereon.

2. A electrophotographic color printing arrangement according to claim 1 wherein each developing unit includes a toner supply container extending substantially vertically upwardly from the developing unit and laterally adjacent to the path of the photoreceptor for supplying toner to the developing unit.

3. An electrophotographic color printing arrangement according to claim 2 wherein the toner supply containers contain yellow, magenta, cyan and black toners respectively and wherein the container for the black toner is larger than the containers for the other color toners.

4. A electrophotographic color printing arrangement according to claim 1 including a bypass sheet feed tray disposed above the substrate supply container for supplying an alternate substrate sheet.

5. A electrophotographic color printing arrangement according to claim 1 wherein the photoreceptor extends in two parallel paths between the support rollers.

6. A electrophotographic color printing arrangement according to claim 1 including a third support roller for supporting the photoreceptor in a generally triangular path.

7. A electrophotographic color printing arrangement according to claim 1 wherein the photoreceptor has a transparent base and wherein each of the printing-stations includes a light emitting printhead adjacent to the inner surface of the photoreceptor preceding the corresponding developing unit and a charging unit adjacent to the outer surface of the photoreceptor preceding the light emitting printhead with respect to the direction of motion of the photoreceptor.

8. A electrophotographic color printing arrangement according to claim 1 including a cleaning unit adjacent to the outer surface of the photoreceptor for cleaning the surface of the photoreceptor following transfer of a developed image to a substrate and for storing toner cleaned from the surface of the photoreceptor.

9. A electrophotographic color printing arrangement according to claim 1 including a housing enclosing the photoreceptor belt, the plurality of printing stations, the substrate supply container, the transfer station and the fuser unit, and an output tray adjacent to an outer surface of the housing for receiving printed substrate sheets from the fuser unit.

10. A electrophotographic color printing arrangement according to claim 1 wherein the path of the photoreceptor adjacent to the printing stations extends at an angle between about 40° and about 55° with respect to the horizontal.

11. An electrophotographic color printing arrangement comprising:

a housing;

a photoreceptor belt disposed within the housing and supported for motion between an upper roller and a lower roller in a path having a lower run extending at an angle to the horizontal; and a plurality of printing stations disposed adjacent to the lower run of the photoreceptor path, each of the printing stations including a developer unit having a portion which extends laterally outside the path of the photoreceptor belt in a direction parallel to the surface of the photoreceptor belt.

12. An electrophotographic color printing arrangement according to claim 11 wherein the plurality of printing stations includes an upper printing station disposed adjacent to the upper roller and a lower printing station disposed adjacent to the lower roller and at least one other printing station disposed between the upper and lower printing stations.

13. An electrophotographic color printing arrangement according to claim 12 including a toner supply container for each developer unit associated with the portion of the developer unit extending laterally outside the path of the photoreceptor belt.

14. An electrophotographic color printing arrangement according to claim 13 wherein each toner container projects upwardly from the corresponding developer unit above the lower run of the photoreceptor path.

15. An electrophotographic color printing arrangement according to claim 14 wherein the toner container associated with the developer unit for the lower printing station is larger than the other toner containers.

16. An electrophotographic imaging system comprising:

a photoreceptor belt supported for a motion in a path including a lower run that extends at an angle to the horizontal between an upper roller and a lower roller;

a plurality of printing stations adjacent to the path of the photoreceptor belt for producing successive images on the photoreceptor belt;

the plurality of printing stations including an upper printing station adjacent to the upper roller and a lower printing station adjacent to the lower roller and at least one other printing station between the upper and lower printing stations so that a vertical distance between the upper roller and each of the printing stations increases successively from the upper printing station to the lower printing station; and a plurality of toner containers each associated with the corresponding printing station and positioned so that the toner container extends substantially vertically upwardly from the printing station, the height of the toner container associated with the lower printing station being greater than that of the toner container associated with the upper printing station.

17. An imaging system according to claim 16 wherein the toner container associated with the lower printing station contains black toner.

18. An imaging system according to claim 17 wherein each of the printing stations includes a developer unit positioned adjacent to the lower run of the photoreceptor belt.

19. An imaging system according to claim 18 wherein a portion of each developer unit extends laterally outside the path of the photoreceptor belt.

20. An imaging system according to claim 19 wherein each of the toner containers extends upwardly from the portion of the corresponding developer unit extending laterally outside the path of the photoreceptor belt.

* * * * *